United States Patent [19]

Zeindler et al.

[11] 4,263,989

[45] Apr. 28, 1981

[54] APPARATUS FOR SELECTING AN ELEVATOR CABIN

[75] Inventors: Stephan Zeindler, Gunzwil; Jiri Kiml, Ebikon, both of Switzerland

[73] Assignee: Inventio AG, Hergiswil, Switzerland

[21] Appl. No.: 66,444

[22] Filed: Aug. 14, 1979

[30] Foreign Application Priority Data

Aug. 22, 1978 [CH] Switzerland ..... 8894/78

[51] Int. Cl.[3] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 2,828,476 | 3/1958 | Eames | 187/29 |
| 3,236,332 | 2/1966 | Burgy et al. | 187/29 |
| 3,388,376 | 6/1968 | Magee | 187/29 |
| 3,428,148 | 2/1969 | Jacobs | 187/29 |
| 3,703,222 | 11/1972 | Lustl et al. | 187/29 |
| 4,147,235 | 4/1979 | Henry et al. | 187/29 |

*Primary Examiner*—J. V. Truhe
*Assistant Examiner*—W. E. Duncanson, Jr.
*Attorney, Agent, or Firm*—Werner W. Kleeman

[57] ABSTRACT

An apparatus for selecting an elevator cabin at a transportation installation, especially an elevator system, for direct travel of an elevator group, controlled by means of a group control, possesses additional storey call transmitters and storey call storages. The storey call storages are connected with a call blocking device having infed thereto a first signal train or sequence produced during scanning of the storey call storages. The call blocking device possesses further inputs, to which there is infed information blocking already allocated calls, so that at its output there appears a second signal train or sequence no longer containing the allocated calls. This output is connected with a respective input of call allocation devices operatively associated with the elevators. The call allocation devices are operatively interconnected with one another by means of a switching circuit. Upon the occurrence of a coincidence signal of an elevator which is ready to service a storey call, the related call allocation device is prepared for the call allocation. Upon subsequent occurrence of a storey call there appears at the output of the call allocation device a control signal which triggers the direct travel.

4 Claims, 5 Drawing Figures

APPARATUS FOR SELECTING AN ELEVATOR CABIN

CROSS-REFERENCE TO RELATED APPLICATIONS

This application contains related subject matter to U.S. Pat. Application Ser. No. 957,335, filed Nov. 2, 1978 and commonly assigned herewith.

BACKGROUND OF THE INVENTION

The present invention relates to a new and improved construction of transportation installation, and, more specifically, relates to apparatus for the selection of an elevator cabin of an elevator system or the like.

In its more particular aspects the invention relates to apparatus for selecting an elevator cabin or the like for direct travel, from an elevator group controlled by means of a group control. There are provided storey call storages, controllable by means of storey call transmitters, and each elevator of the elevator group has operatively associated therewith a selector which signals or indicates the site of the elevator cabin. The apparatus is provided with additional storey call transmitters and additional storage elements controllable by such last-mentioned storey call transmitters.

The purpose of such type equipment is to be able to call, within a group of elevators, one elevator cabin independent of the servicing sequence governed by the relevant group control, in order to accomplish direct travel of the selected elevator cabin, for instance as is needed when transporting beds, stretchers or other conveying devices in hospitals in the event of an emergency.

An elevator system known to the art from, for instance, German Pat. No. 2,418,129, contemplates the provision of a collective control and an individual travel control. All of the elevators of the group continuously work with the collective control as long as there is no need to transport beds or the like. For the input of a bed call there are provided separate storey call transmitters. However, these are first capable of being used if they are activated when a bed comes into proximity with an induction coil. If there is present a bed call, then to the extent that a free elevator is available the same is selected and switched-over to individual travel control. The latter is equipped with a waiting or holding device, by means of which the storey calls are serviced in the timewise sequence of input thereof. The report that the elevators are free is delivered to a selector device, which also when there are free a number of elevators, only releases one of the elevators for servicing the bed call. If there is no elevator available for a bed call, then, the elevator which next passes the bed call-holding location, and which elevator is just in the process of transporting individuals, is stopped, and by appropriate signaling the passengers are requested to leave the elevator cabin.

The drawback of such type controlled elevator installations particularly resides in the fact that, also in the presence of a number of free elevators, only one single elevator is rendered available for service. Thus, there is not accomplished any group formation, so that there is not insured the most efficient determination of the elevator cabin which, in terms of its location, is most favorable for servicing the call. Only after reception of the call by the control is there rendered available a further unoccupied elevator, and the call, without taking into consideration its position in relation to the site of the elevator cabin, is processed in the timewise sequence of the call inputs, with the result that there can exist appreciable empty travel of the elevators.

SUMMARY OF THE INVENTION

Therefore, with the foregoing in mind it is a primary object of the present invention to provide a new and improved construction of apparatus for selecting an elevator cabin which is not afflicted with the aforementioned drawbacks and shortcomings of the prior art proposals.

Another and more specific object of the present invention aims at providing a new and improved construction of apparatus for selecting an elevator cabin, by means of which the existing disadvantages explained above with respect to the prior art systems, during the servicing of emergency calls, are effectively avoided or appreciably at least minimized, and wherein particularly by determining the most favorable empty elevator cabin in terms of its travel position, and, in the event that there are no empty elevator cabins available, by determining the most favorable position of the occupied elevator cabin of an elevator group, there is possible a preferred, timewise-optimum servicing of emergency calls.

Yet a further significant object of the present invention aims at the provision of apparatus for selecting an elevator cabing from a group of elevator cabins of an elevator installation, wherein it is possible to determine whenever the need exists, such as in the presence of an emergency call, the location of that elevator cabin which is closest to the elevator call, which is available or can be rendered available, for the most prompt response to the emergency call.

Now in order to implement these and still further objects of the invention, which will become more readily apparent as the description proceeds, the apparatus for selecting an elevator cabin of an elevator installation or system contemplates connecting the outputs of the additional storage elements, which are scanned by a scanner and which outputs are connected together by means of diodes, with an input of a call blocking device. At the call blocking device, during scanning, there appears a first signal sequence or train containing all of the stored storey calls. The call blocking device possesses further inputs which carry information blocking already allocated calls and an output at which there appears a second signal sequence or train containing the remainder of the still to be allocated storey calls. The call blocking device is connected with a respective input of the call allocation devices which are operatively correlated with the individual elevators of the group. These call allocation devices are connected with one another by a switching circuit. This switching circuit, upon the occurrence of a coincidence signal or information of an elevator ready for servicing a storey call, generated upon coincidence of the scanner and selector position, eliminating from the call allocation the call allocation devices operatively associated with the other elevators. Upon subsequent occurrence of a storey call, contained in the second signal sequence, there appears at the output of the call allocation device correlated with the elevator which is ready for servicing, a control signal which triggers direct travel of the elevator.

The advantages which can be realized with the invention particularly reside in the fact that, also during the servicing of emergency calls, both the free and also all of the occupied elevators form a group which is operatively linked with the group control, so that in any event there can be selected that elevator cabin which is most favorable in terms of its location and there are beneficially avoided prolonged empty travel and waiting terms. A further advantage of the invention resides in the fact that a number of emergency calls can be simultaneously infed and can be practically simultaneously processed by the control.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

At this point it is briefly mentioned that the signals or information or data, referred to in the detailed description of the invention to follow, can assume, as is conventional for designating logical states of digital circuits, the logical states or values "1" and "0" correlated to two different voltage levels or peaks. Equally, instead of using the designation "signal sequence" or "signal train" as used in the description of the invention, there also will be referred to the designation "band".

Figure 1:
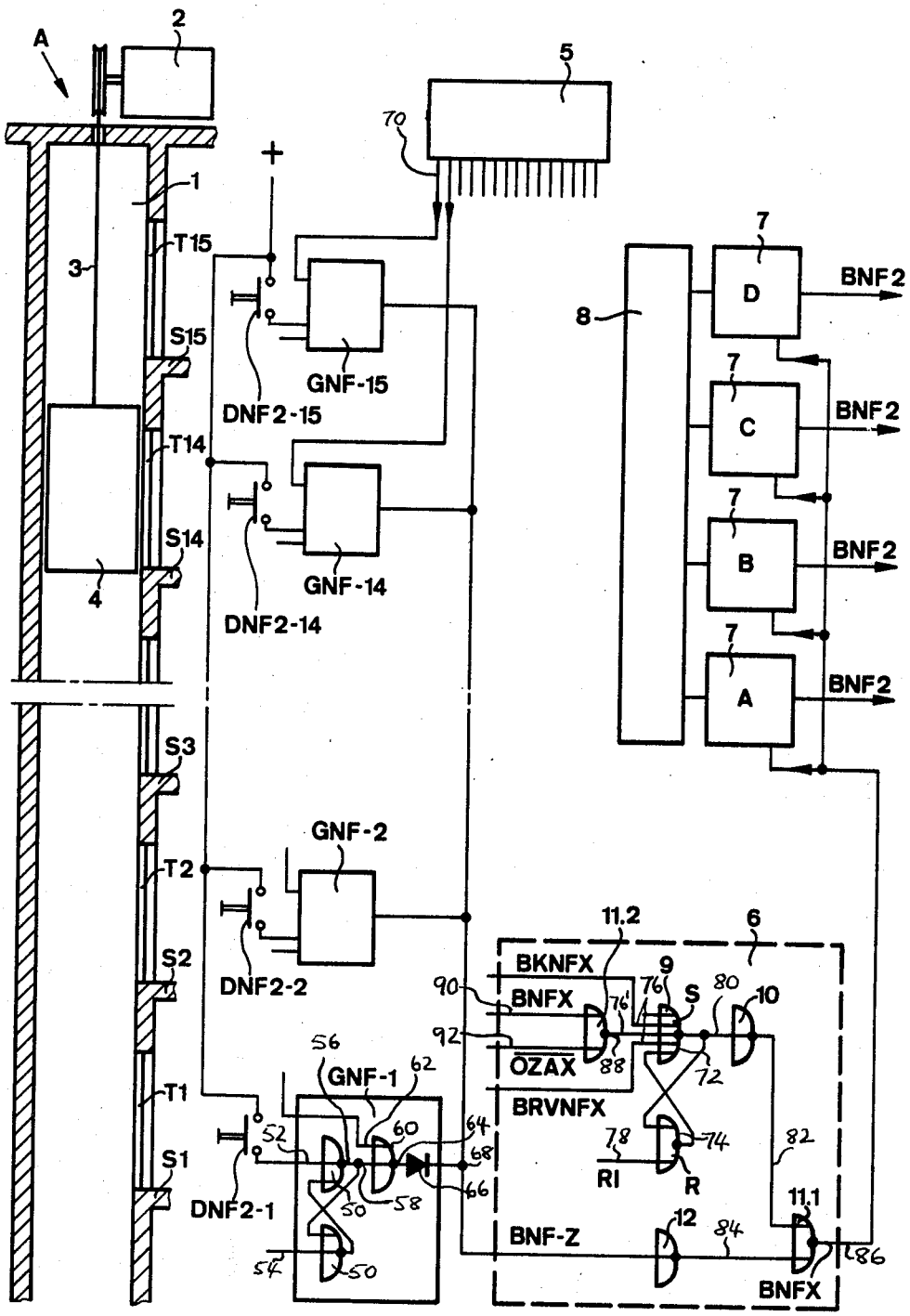
FIG. 1 is a schematic illustration of an elevator of an elevator group of a transportation installation and composed of four elevators and equipped with the inventive apparatus for the selection of an elevator cabin.

Turning attention now to the drawings, in FIG. 1 reference character 1 designates an only partially illustrated elevator chute or shaft for an associated elevator A of a group of, for instance, four elevators A, B, C and D of an elevator installation or system. A conveyor or drive machine 2, controlled by a conventional and therefore not particularly illustrated drive control, drives by means of a conveyor or drive cable 3 or equivalent structure an elevator cabin 4 guided within the elevator chute or shaft 1. With the exemplary embodiment under discussion, and given simply by way of example and not limitation, this elevator cabin 4 services fifteen storeys or landings S1 to S15 of a building. Reference characters T1 to T15 constitute hoistway doors which are arranged at such storeys or floors S1 to S15. In addition to the not particularly illustrated, normally available storey call storages operatively associated with the individual storeys S1 to S15 and provided for the elevator group control, there are further storages or storage elements GNF-1 to GNF-15, hereinafter referred to as emergency call storages. These emergency call storages GNF-1 to GNF-15 are controllable by means of storey call transmitters DNF2-1 to DNF2-15, hereinafter referred to as emergency call transmitters, which are arranged at the storeys or floors S1 to S15. The emergency call transmitters DNF2-1 to DNF2-15 are constructed as key-operated contacts, or equivalent structure, and are arranged in addition to the likewise not particularly illustrated but conventional storey call transmitters serving as part of the system operation of the elevator group control.

The elevator group control of the exemplary embodiment of the invention, is for instance advantageously a collective control which may be of the type known to the art and disclosed in Swiss Pat. No. 387,903, the disclosure of which is incorporated herein by reference, and has a time-dependent and a position-dependent stepping mechanism. The time-dependent stepping mechanism, controlled by a generator which produces an uninterrupted signal sequence, continuously scans the storage elements serving for the storage of the storey calls, in succession from the lowermost to the uppermost and from the uppermost to the lowermost storey and delivers a signal sequence corresponding to the stored storage calls. The position-dependent stepping mechanism produces, in each case, during travel of the elevator cabin from a storey, a signal corresponding to the following storey in the UP-direction or DOWN-direction, as the case may be. Now if with the same direction of travel or with standstill of the elevator cabin the scanning position and the site signal of the elevator cabin coincide, then there are produced appropriate coincidence signals. Upon coincidence of a coincidence signal with a signal, corresponding to a stored storey call, of the signal train delivered by the time-dependent stepping mechanism, there is produced a holding or stop signal which is infed to the travel control of the elevator. In this way there are serviced by the elevator cabin, in succession, all service calls which are located in the direction of travel of the elevator cabin and which have the same direction.

The emergency call storages GNF-1 to GNF-15 each essentially consist of a storage composed of two NOR-gates or elements 50, whose one input 52 is connected with a terminal of the related emergency call transmitter DNF2-1 to DNF2-15 and which is connected via the second input or connection 54 with the positive terminal of a not particularly illustrated voltage source. The second input 54 of the storage, after servicing an emergency call, has infed thereto an extinguishing signal produced in any suitable manner. The output 56 of the storage is connected with one input 58 of a NOR-gate or element 60 having two inputs 58 and 62. The output 64 of the NOR-gate 60 is connected, by means of a diode 66, with an output 68 which is common to all of the emergency call storages GNF-1 to GNF-15. The second input 62 of the NOR-gate or element 60 is connected with an electronic scanner or feeler 5. This electronic scanner or feeler 5 may be structured from digital elements, similar to the time-dependent stepping mechanism known from the aforementioned Swiss Pat. No. 387,903, and, apart from having the fifteen outputs 70 connected with the emergency call storages GNF-1 to GNF-15, possesses not particularly illustrated inputs and outputs operatively connected with the elevator group control. The scanner device or scanner 5, operating for instance with a scanning frequency of, by way of example, 1000 Hz, scans the emergency call storages GNF-1 to GNF-15 in succession from the lowermost to the uppermost and from the uppermost to the lowermost storey in continuous fashion. Consequently, the second input 62 of each related NOR-element 60 has infed thereto a signal which is generated by the scanner 5 and which in each case is null during scanning of the related storey. If there are stored emergency calls, then the first inputs 58 of the NOR-gates 60 of the related emergency call storages GNF-1 to GNF-15 likewise are at null, and there appears at the common output 68 of all of the emergency call storages a first signal sequence BNF-Z which contains all of the stored emergency calls.

The common output 68 of all of the emergency call storages GNF-1 to GNF-15 is connected in circuit with a call blocking device 6 common to all of the elevators A, B, C and D of the elevator group. This call blocking device 6 is assigned the task of insuring for the transmission of a minimum call pulse length and suppresses certain emergency calls contained in the signal sequence or train BNF-Z, for instance after an emergency call has been allocated to an elevator.

The call blocking device 6 comprises a storage 9 composed of two NOR-gates or elements 72 and 74, wherein the S-NOR-gate 72 has at least three inputs 76, two of which have infed thereto the information or data BKNFX and BRVNFX, respectively, to be considered more fully hereinafter and produced in any suitable and therefore not further illustrated manner.

The R-NOR-gate 74 of the storage 9 has an input 78 to which there is infed resetting or reset information RI periodically produced at the scanner frequency by means of a not further shown conventional pulse circuit. The output 80 of the storage 9 is connected in circuit, by means of a first NOT-gate or element 10, with a first input 82 of a first NOR-gate or element 11.1, the second input 84 of which is connected by means of a second NOT-gate or element 12 with the common output 68 of all emergency call storages GNF-1 to GNF-15 and whose output 86, carrying a second signal sequence or train BNFX, is connected with the call allocation devices 7. The third input, indicated specifically by reference character 76' of the S-NOR-gate 72 of the storage 9 is connected with the output 88 of a second NOR-gate or element 11.2, whose one input 90 has infed thereto the second signal sequence or train BNFX and the other input 92 of which has infed thereto an oscillator signal $\overline{OZAX}$ produced by a suitable and therefore not further illustrated squarewave operator.

The information or signals appearing at the different inputs and outputs of the call blocking device 6 have the following meanings:

BNF-Z—the signal sequence or train, generated by the electronic scanner and corresponding to all of the infed emergency calls, wherein BNF-Z=1 corresponds to a stored emergency call;

BNFX—the signal sequence or train of the emergency calls which have not yet been allocated to an elevator cabin;

BKNFX—the coincidence signal which always assumes the logic state "1" upon the presence or arrival of the elevator cabin. It prevents servicing of an emergency call by a second elevator;

BRVNFX—the emergency call reservation signal of an elevator cabin selected for an emergency call and which assumes the logic state "1" and appears at the same time as the emergency call allocated to such elevator cabin;

$\overline{OZAX}$—the signal sequence or train generated by a squarewave generator, the frequency of which is equal to the scanning frequency of the scanner 5; and RI—the reset information, the frequency of which likewise corresponds to the scanning frequency.

As explained, the call blocking device 6 is connected at its output side, generally indicated by reference character 86, with four call allocation devices 7, each correlated with the elevators A, B, C and D of the elevator group, and the details of which will be discussed more fully hereinafter in conjunction with the description of FIG. 3. These call allocation devices 7 are assigned the task of correlating an emergency call to the most favorable travel condition of the elevators, for instance the next empty elevator cabin.

The call allocation devices 7 are mutually connected with one another by means of a switching circuit 8, details of which also will be considered more fully hereinafter in conjunction with FIG. 3. This switching circuit 8 has the function, in the presence of an operationally ready, empty cabin with closed doors, of precluding the emergency call servicing by the remaining elevators. A further task which is assigned to the switching circuit 8 is to determine the priority of the elevators A, B, C and D, and in the example under discussion the elevator D has the highest priority. If, for instance, the elevator cabins of the elevators A and C are located at the same storey or floor and if both fulfil the conditions necessary for the allocation of the emergency call, then the elevator C is allocated the emergency call.

Figure 3:
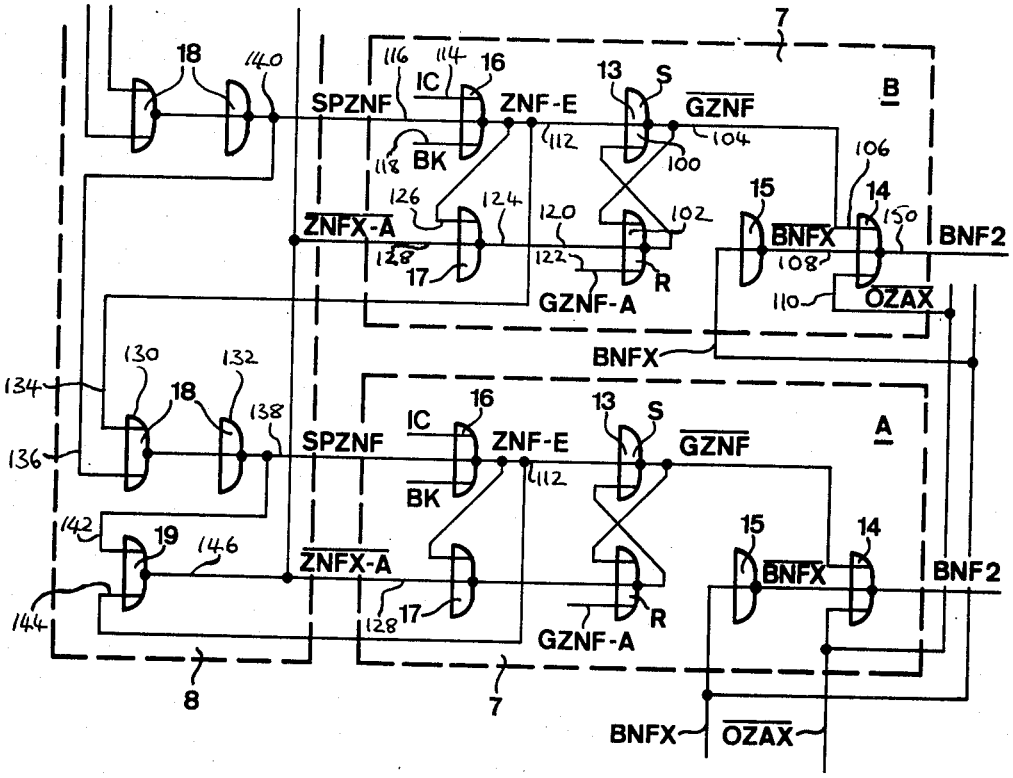
FIG. 3 is a detailed circuit diagram of two call allocation devices, operatively correlated with the elevators A and B, of the apparatus shown in FIG. 1, and further showing part of a switching circuit which mutually interconnects the call allocation devices.

In FIG. 3 reference character 13 designates a storage composed of two NOR-gates or elements 100 and 102. The output 104 of the storage 13 is connected with one input 106 of a NOR-gate or element 14 having three inputs, namely the mentioned input 106 and the further inputs 108 and 110. The second input 108 of the NOR-gate 14 has infed thereto, by means of a NOT-gate or element 15, the signal sequence or train BNFX, which has been inverted to $\overline{BNFX}$, appearing at the output 86 of the call blocking device 6. At the third input 110 of this NOR-gate 14 there is applied the oscillator signal $\overline{OZAX}$. The S-NOR-gate 100 of the storage 13 is connected with the output 112 of a NOR-gate or element 16 having three inputs 114, 116 and 118. The input 116 of the NOR-gate 16 has applied thereto a blocking information or signal SPZNF delivered by the switching circuit 8, whereas both of the other inputs 114 and 118 have infed thereto the information or signals IC and BK, respectively, which are generated in any appropriate and therefore not particularly illustrated manner. The R-NOR-gate 102 of the storage 13 has two inputs 120 and 122, there being applied to the input 122 the blocking information or signal GZNF-A, produced in any suitable fashion, and the other input 120 is connected with the output 124 of a delay-NOR-gate or element 17 having two inputs 126 and 128. The one input 126 of the delay-NOR-gate 17 is coupled with the output 112 of the NOR-gate 16, whereas the second input 128 has applied thereto an extinguishing information or signal $\overline{ZNFX}$-A generated in the switching circuit 8.

Now this switching circuit 8 comprises a respective series circuit 18 operatively associated with the related call allocation devices 7 for the elevators A, B, C and composed of a NOR-gate 130 and a NOT-gate 132. The NOR-gate 130 has two inputs 134 and 136. The output 138 of the series circuit 18 is connected in each case with the NOR-gate 16 of the related call allocation device 7. The one input 136 of the NOR-gate 130 of the series circuit 18 is connected in each case with the output 140 of the preceding series circuit 18, whereas the second input 134 is connected with the output 112 of the NOR-gate 16 of the preceding call allocation device 7. The elevator of highest priority, here assumed to be the elevator D, does not have operatively associated therewith any series circuit 18. The output 138 of the series circuit 18, correlated to the lowest order or lowest priority elevator, here assumed to be the elevator A, is additionally connected with one of the inputs 142 of a NOR-gate or element 19 having two inputs, namely the mentioned input 142 and the additional input 144. This second or additional input 144 is connected with the output 112 of the NOR-gate 16 of the call allocation device 7 which is correlated with the elevator A. The output 146 of the NOR-gate or element 19 is connected with the second input 128 of the delay-NOR-gate 17 of all call allocation devices 7.

Figure 4:
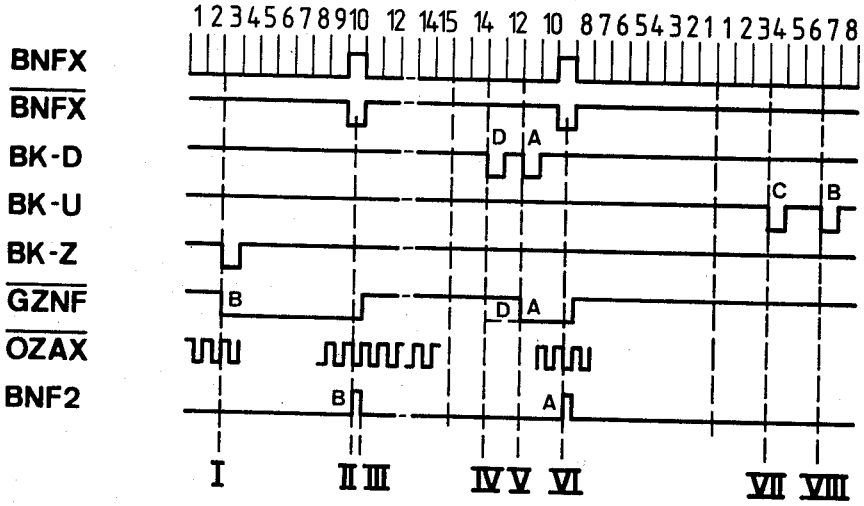
FIG. 4 is a graph showing the course as a function of time of the signal trains or sequences appearing at the inputs and at the output of the call allocation device shown in FIG. 3.

The information or signals, appearing at the different inputs and outputs of the call allocation devices 7 and the switching circuit 8, have the following meanings:

GZNF-A—the blocking information which, in the presence of disturbance free operation of an elevator of the group, which additionally does not have allocated thereto any special function or task and which is not occupied by emergency call servicing, assumes the logical state or value "0";

IC—the blocking information, which assumes the logical state or value "0", when all of the elevators of the group are occupied, or which in each case assumes the logical value "0" for at least one free elevator of the group, when its elevator cabin is empty and its doors are closed and the information or signal GZNF-A likewise assumes the logical state "0" for the related elevator;

BK—the coincidence information or signal which, upon coincidence of scanning and selector position with the same direction of travel or upon standstill of an elevator cabin, assumes the logical state "0", wherein in FIG. 4 under the information or signal BK-D there is to be understood a downward direction of travel, under the information or signal BK-U an upward direction of travel, and under the information or signal BK-Z standstill of the elevator cabin;

BNF2—the signal sequence or train appearing at the output of the call allocation device 7 of the elevator cabin selected for the emergency call servicing operation, whose signals BNF2=1 correspond to the emergency calls BNFX=1 contained in the band BNFX;

$\overline{OZAX}$—the signal sequence or train generated by a squarewave generator, and the frequency of which is equal to the scanning frequency of the scanner 5;

$\overline{ZNFX\text{-}A}$—the extinguishing signal produced in the switching circuit 8 upon the occurrence of the coincidence information BK=0 of an elevator cabin which is operationally ready for servicing an emergency call, this extinguishing signal resetting the storages 13 of the remaining call allocation devices 7;

$\overline{GZNF}$—the information or signal, appearing at the output of the storage 13 of the call allocation device 7 corresponding to the operationally ready elevator cabin, which information or signal likewise assumes the logic state "0" upon occurrence of the signal condition BK=0 and upon occurrence of the extinguishing signal $\overline{ZNFX\text{-}A}$=0 and the blocking information GZNF-A=1 assumes the logic state or value "1";

SPZNF—the blocking information or signal, produced in the switching circuit 8 upon occurrence of the signal condition BK=0 of an elevator cabin which is operationally ready for servicing an emergency call, wherein in each case SPZNF=1 precludes the call allocation devices 7 of the lower order elevators from the emergency call allocation; and ZNF-E—the information or signal present at the output of the NOR-gate 16, wherein by means of the information or signal ZNF-E=1 there is set the storage 13.

Figure 2:
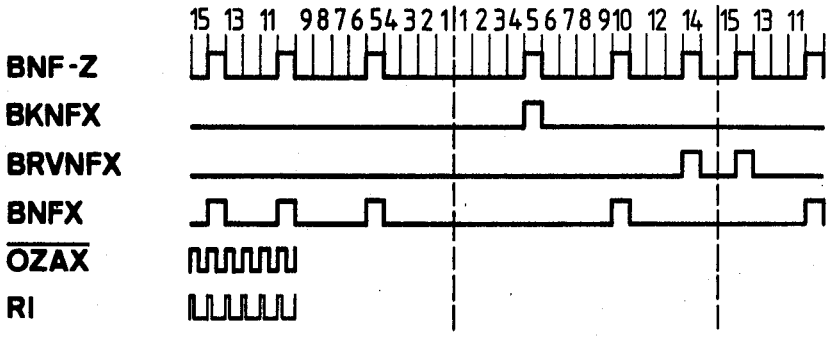
FIG. 2 is a graph showing the course as a function of time of the signal trains or sequences appearing at the inputs and at the output of a call blocking device contained in the apparatus of FIG. 1.

Having now had the benefit of the foregoing discussion and description of the apparatus for selecting an elevator cabin as contemplated by the invention, its mode of operation will be considered and is as follows:

It is assumed that there have been infed emergency calls for the storeys or floors S5, S10 and S14 and the elevator cabin C is at the storey S5 or just is arriving thereat. Since, in this case, the coincidence signal appearing at an input 76 of the storage 9 of the call blocking device 6 assumes the state BKNFX=1, the emergency call for the storey S5 no longer appears in the band BNFX, that is to say, it is blocked for this storey S5 and no longer can be allocated to any other elevator (FIGS. 1 and 2). Furthermore, it is assumed that by means of the call allocation device 7, correlated to the elevator D, the emergency call for the storage S14 is allocated, in a manner to be described more fully hereinafter, to the elevator D. The information signal BRVNFX=1, thereafter delivered by the elevator cabin D to the storage 9 of the call blocking device 6 (FIG. 1), likewise causes blocking of the relevant emergency call, which, thus, no longer can be allocated to any other elevator of the group. Thus, in the band BNFX there only appears the emergency call for the storey S10 (FIG. 2).

Furthermore, it is assumed that at this point in time the elevator cabins A and B are operationally ready at the storey S3. Since the information IC of the traveling elevator cabin C and D assumes the logic state "1", the information ZNF-E of the call allocation devices 7 correlated to such elevators assumes the logic state "0", and thus, the information SPZNF for the elevator B likewise assumes the logic state "0". Hence, with the information IC=0 and BK-Z=0 the output information ZNF-E of the NOR-gate 16 of the call allocation device 7 for the elevator B assumes the logic state "1" and the information SPZNF for the elevator A assumes the logic state or value "1". Thus, there is set the storage 13 of the call allocation device 7 correlated to the higher order elevator B and the information $\overline{GZNF}$=0 (FIG. 3 and the time I, FIG. 4). With the scanner position for the storey S10 there is fulfilled the condition BNFX=1 ($\overline{BNFX}$=0) and $\overline{OZAX}$=0, so that at the output 150 of the NOR-gate 14 there appears a control signal BNF2=1 (time II, FIG. 4). The signal $\overline{OZAX}$=0, and thus, the control signal BNF2=1, is half as wide as the signal BNFX=1, so that there is avoided overlapping of two neighboring emergency calls.

Upon change of the information ZNF-E of the call allocation device 7, correlated to the elevator B, from the logic state "0" to the logic state "1" the extinguishing signal assumes the condition $\overline{ZNFX\text{-}A}$=0, and the storage 13 of the call allocation devices 7 of the elevators A, C, D are reset. Now if the information BK-Z again assumes the logic state "1", and thus, the information ZNF-E again assumes the logic state "0", then the delay NOR-gate 17 insures that the logic state "0" appearing at its output 124 is maintained until change-over of the information or signal $\overline{ZNFX\text{-}A}$ from the logic state "0" to the logic state "1", so that the storage 13 of the call allocation device 7, correlated with the elevator B, is not reset (FIG. 3).

The emergency call for the storey S10, contained in the band BNF2, is superimposed upon the cabin call band serving for the travel control of the elevator B, whereupon the elevator B begins to move in direct travel in the direction of the storey S10. If during the direct travel there is required a direction change, then this is accomplished by stopping at the next possible storey without opening the doors. At the same time the elevator B is disconnected in any suitable and therefore not particularly described fashion from the group control, wherein, in particular, possibly present cabin calls are extinguished and there is blocked any renewed call input. With the acceptance of the emergency call there is fulfilled the information condition GZNF-A=1, so that the storage 13 is reset (time III, FIG. 4). Directly after acceptance of the emergency call there occurs an optical and acoustical signaling of the servicing elevator by a blinking illumination of both further travel signals or attention signal at the corresponding elevator chute or shaft entrance and by sounding a gong or other audible signal. After the direct travel to the storey S10, by means of a standard time-delay device, the elevator cabin is automatically reserved for a predetermined time so as to carry out a subsequent direct travel. Only one call can be infed to the elevator cabin for this direct travel.

Figure 5:
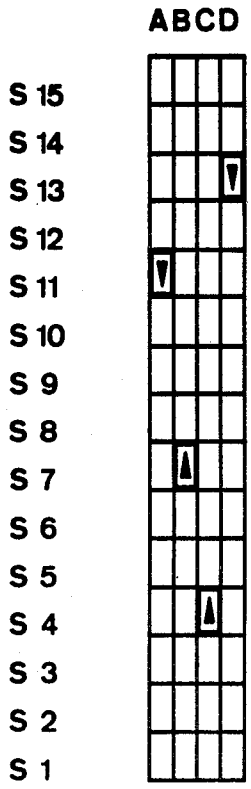
FIG. 5 is a schematic illustration of the elevator group composed of the four elevators.

According to a further example it is assumed that an emergency call is infed at storey or floor S9, but all of the four elevators A, B, C and D are occupied, and further, the elevator cabins A and D are located in downward travel at the region of the storeys S11 and S13, respectively, and the elevator cabins B and C are in upward travel at the region of the storeys S7 and S4, respectively (FIG. 5). At the time IV (FIG. 4) the information BK-D assumes the logic state "0" for the elevator D, so that with IC=0 the information at the output 112 of the NOR-gate 16 assumes the condition ZNF-E=1 and there is set the storage 13 of the call allocation device 7 correlated with the elevator D. Upon attaining the scanner position 11 the information BK-D assumes the logic state "0" for the elevator A, so that by means of the signal or information states IC=0 and SPZNF=0 there is satisfied the condition that the information ZNF-E=1 and there is set the storage 13 of the call allocation device 7 for the elevator A (FIG. 3 and time V, FIG. 4). At the same time since $\overline{ZNFX\text{-}A}=0$ the storage 13 resets the call allocation device correlated to the elevator D. During the further course of the scanning operation there is attained the scanning position correlated to the storage S9 and the infed emergency call is allocated, in the described manner, to the elevator cabin A (time VI, FIG. 4). The signals BK−U of the elevator cabins C and B, which signals appear at the times VII and VIII, are not taken into account during allocation, since they first occur after the allocation operation has been completed (FIG. 4).

Instead of using a conventional group collective control, as explained in conjunction with the preceding exemplary embodiment, the inventive apparatus also can be combined with other types of control systems; for instance it can be combined with a group single travel control of the type disclosed in the commonly assigned copending United States application Ser. No. 972,890, filed Dec. 26, 1978. It is also possible to utilize the inventive apparatus always only for the same elevator of the group, wherein, however, there only can be simultaneously infed in each case one emergency call.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. In an apparatus for selecting an elevator cabin for direct travel from an elevator group controlled by a group control, wherein there are provided storey call storages controllable by storey call transmitters and each elevator of the group has operatively associated therewith a selector which signals the site of the elevator cabin, additional storey call transmitters and additional storages controllable by said additional storey call transmitters, the improvement comprising:

scanner means for scanning said additional storages;

said additional storages having outputs;

diode means for interconnecting the outputs of said additional storages which are scanned by said scanner means;

a call blocking device having a first input;

said outputs of said additional storages being connected with said first input of said call blocking device;

a first signal sequence containing all stored storey calls appearing during scanning at the first input of said call blocking device;

said call blocking device having further inputs and an output;

said further inputs of said call blocking device carrying information for blocking already allocated calls;

a second signal sequence, containing the remainder of the yet to be allocated storey calls, appearing at the output of the call blocking device;

call allocation devices each having an input;

said call blocking device being connected with a respective input of the call allocation devices correlated with the individual elevators of the elevator group;

switching circuit means for interconnecting the call allocation devices with one another;

said switching circuit means in the presence of an information signal signalling a free cabin and, also upon the occurrence of a coincidence information signal signalling that this free cabin is at a storey, said coincidence information signal being generated upon coincidence of the scanner and selector position, prepares the appropriate call allocation device and eliminated the remaining call allocation devices from the call allocation; and upon subsequent occurrence of a storey call contained in the second signal sequence there appears a control signal at the output of the call allocation device correlated to the operationally ready elevator and which control signal triggers a direct travel.

2. The improvement as defined in claim 1, wherein:

said call blocking device comprises a storage composed of two NOR-gates having an S-NOR-element and a R-NOR-element;

said S-NOR-element having two inputs to which there is applied said blocking information;

said R-NOR-element having an input to which there is applied reset information at the scanning frequency of the scanner means;

a first NOR-element having a first input, a second input and an output;

said storage having an output;

a first NOT-element for connecting the output of said storage with the first input of the first NOR-element;

a second NOT-element;

said second input of the first NOR-element being connected by means of said second NOT-element with the first input of the call blocking device and the output of said first NOR-element with the output of the call blocking device;

a second NOR-element having an output;

a further input of the S-NOR-element of the storage being connected with said output of the second NOR-element;

said second NOR-element having a first input and a second input; and the first input of said second NOR-element being capable of having applied thereto the second signal sequence and the second input being capable of having applied thereto an oscillator signal occurring at the scanning frequency.

3. The improvement as defined in claim 1, wherein:

said call allocation device comprises a storage composed of two NOR-gates having an input and an output;

a first NOR-gate having a first input, a second input and a third input;

a NOT-gate;

the output of said storage being connected with said first input of said first NOR-gate;

said second input of said NOR-gate being impinged by means of the NOT-gate with the inverted second signal sequence and the third input being impinged with an oscillator signal;

said two NOR-gates comprising a S-NOR-element and an R-NOR-element;

a second NOR-element having first, second and third inputs and an output;

said S-NOR-element of the storage being connected with the output of said second NOR-gate;

said first input of said second NOR-gate being impinged with a first blocking information;

said second input being impinged with the coincidence information;

said third input being impinged with a second blocking information from the switching circuit;

said R-NOR-element of the storage having a first input and a second input;

said first input of the R-NOR-element being impinged with third blocking information;

a delay-NOR-element having two inputs and an output;

said second input of said R-NOR-element being connected with the output of the delay-NOR-element;

the one input of the delay NOR-element being connected with the output of the second NOR-element and its other input with said switching circuit; and upon simultaneous occurrence of the logic state "0" of said first and second blocking information and the coincidence information said storage of said call allocation device can be set and the call allocation device is prepared for call allocation.

4. The improvement as defined in claim 3, wherein:

said switching circuit means comprises a respective series circuit operatively associated with a respective one of the individual call allocation devices;

each said series circuit comprising a NOR-element having two inputs and a NOT-element;

said series circuit having an output;

the output of the series circuit carrying the second blocking information and being connected with the third input of the second NOR-element of the related call allocation device;

the first input of the NOR-element of the series circuit being connected with the output of the preceding series circuit and the second input being connected at the output of the second NOR-element of the preceding call allocation device;

a further NOR-element having a first input, a second input and an output;

the first input of the further NOR-element being connected with the output of the series circuit and the second input being connected with the output of the second NOR-element of the call allocation device correlated with a predetermined one of the elevators and its output being connected with said other input of the delay-NOR-element of all of the call allocation devices.

* * * * *